US012410662B1

(12) United States Patent
Dobrowolski et al.

(10) Patent No.: US 12,410,662 B1
(45) Date of Patent: Sep. 9, 2025

(54) SHOCK RESISTANT AND LOAD TAILORED TENSILE BAR METHOD, AND SYSTEM

(71) Applicant: Baker Hughes Oilfield Operations LLC, Houston, TX (US)

(72) Inventors: Thomas Dobrowolski, The Woodlands, TX (US); Farhat A. Shaikh, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/958,783

(22) Filed: Nov. 25, 2024

(51) Int. Cl.

| | |
|---|---|
| ***E21B 17/06*** | (2006.01) |
| ***E21B 17/00*** | (2006.01) |
| ***E21B 23/00*** | (2006.01) |
| *E21B 7/04* | (2006.01) |

(52) U.S. Cl.
CPC ..... *E21B 17/006* (2013.01); *E21B 23/00* (2013.01); *E21B 7/04* (2013.01)

(58) Field of Classification Search
CPC ..... E21B 17/07; E21B 17/073; E21B 17/06; E21B 41/00; B62D 1/192; F16B 2200/63
See application file for complete search history.

(56) References Cited

U.S. PATENT DOCUMENTS

| | | | | |
|---|---|---|---|---|
| 5,439,323 | A * | 8/1995 | Nance | E21B 17/01 405/195.1 |
| 6,488,434 | B1 * | 12/2002 | Graeff | B66C 15/00 403/41 |
| 2015/0354289 | A1 * | 12/2015 | Carlsen | E21B 19/004 137/69 |
| 2018/0188144 | A1 * | 7/2018 | Deal | B33Y 50/00 |

* cited by examiner

*Primary Examiner* — Kipp C Wallace
(74) *Attorney, Agent, or Firm* — Baker Hughes Patent Organization

(57) ABSTRACT

A tensile bar, including a first support structure, a second support structure, and a plurality of tensile members extending between the first support structure and the second support structure, each member of the plurality of members extending at least in part in a direction other than longitudinally axially of the tensile bar and from a first point on the first support structure, to a second point on the second support structure, a line between the first point and the second point being parallel to a longitudinal axis of the tensile bar. A method for making the tensile bar, including applying a material from an additive manufacturing machine to a build plate in the form of a layer of the tensile bar. A borehole system, including a borehole in a subsurface formation, a string in the borehole, and a tensile bar disposed within or as a part of the string.

20 Claims, 6 Drawing Sheets

SHOCK RESISTANT AND LOAD TAILORED TENSILE BAR METHOD, AND SYSTEM

BACKGROUND

In the resource recovery and fluid sequestration industries, moving tools into and out of boreholes is common. In some related activities it is sometimes valuable to have a tensile bar in a string system to manage loads of the tools being moved. Specifically, a tensile bar is configured to fail before a maximum tensile rating of the string (e.g. wireline) is exceeded. This means that the tensile bar rather than the string would fail thereby protecting the string itself and ensuring the failure location is at a location that is more desirable than at other potential locations. Common tensile bars are single-piece construction and while they support the purpose for which they are incorporated, they have a track record of suffering from premature failures. Such failures can lead to costly additional operations and lost time.

SUMMARY

An embodiment of a tensile bar, including a first support structure having a longitudinal axis and presenting a first engagement face that crosses the longitudinal axis of the first support structure, the first engagement face having a peripheral surface that is spaced from the longitudinal axis of the first support structure, a second support structure having a longitudinal axis and presenting a second engagement face that crosses the longitudinal axis of the second support structure, the second engagement face having a peripheral surface that is spaced from the longitudinal axis of the second support structure, the second support structure spaced from the first support structure; and a plurality of tensile members extending between the first engagement face and the second engagement face, each member of the plurality of members extending at least in part in a direction other than longitudinally axially of the tensile bar, each member of the plurality of members extending from a first point on the first engagement face to a second point on the second engagement face, a line between the first point and the second point being parallel to a longitudinal axis of the tensile bar.

An embodiment of a method for making the tensile bar, including applying a material from an additive manufacturing machine to a build plate in the form of a layer of the tensile bar, applying the material to the layer, and repeating applying the material until the tensile bar has grown to a full shape of the tensile bar.

An embodiment of a equipment removal tool, including a string, and a tensile bar disposed within or as a part of the string.

An embodiment of a borehole system, including a borehole in a subsurface formation, a string in the borehole, and a tensile bar disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Disclosed herein is a multi-member tensile bar configured to absorb dynamic loads and shocks during operations while simultaneously ensuring adherence to design specifications for breaking. In an embodiment, the multi-member tensile bar may be additively manufactured.

Figure 1:
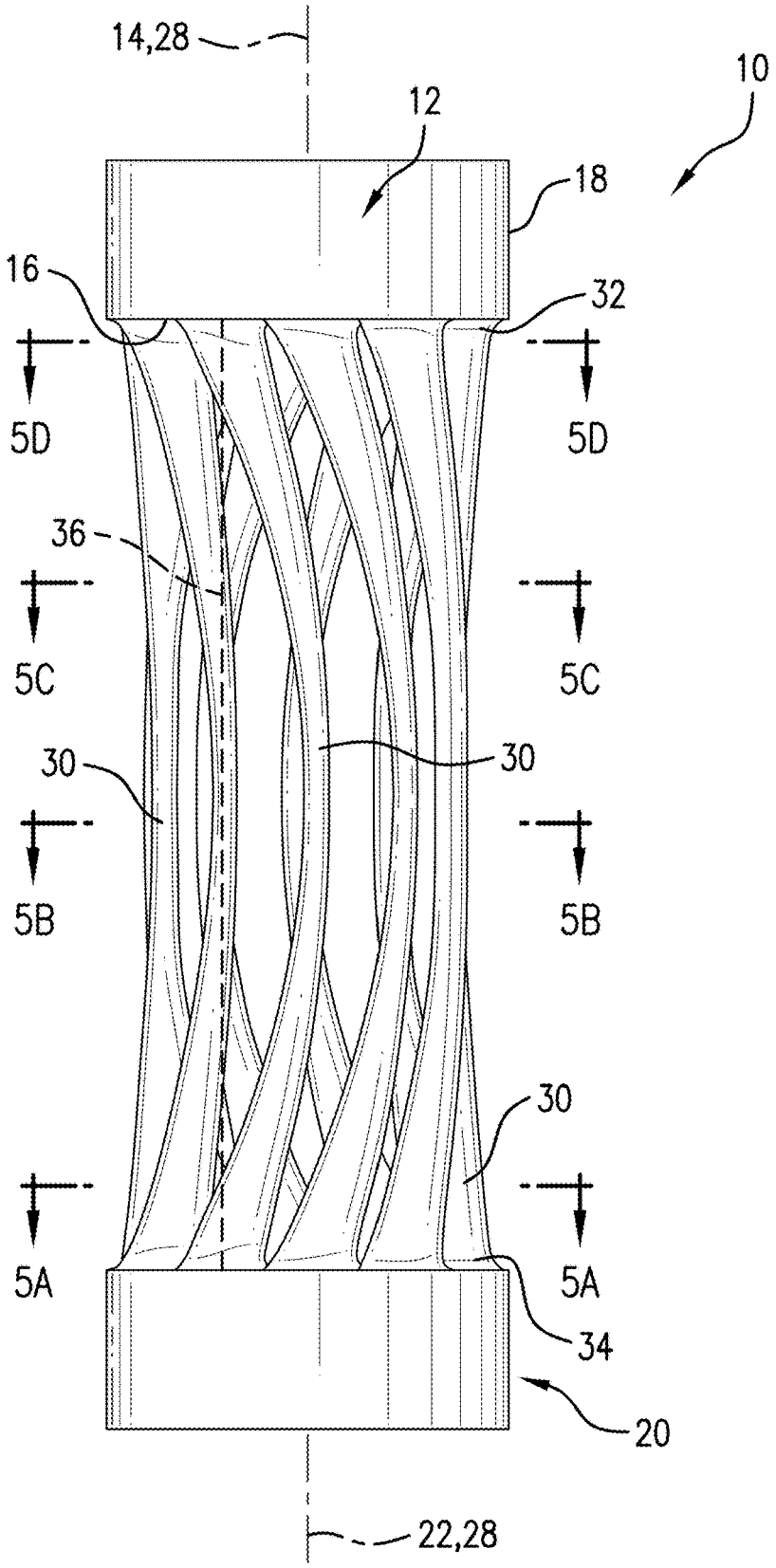
FIG. 1 is a side view of a tensile bar as disclosed herein.
Figure 2:
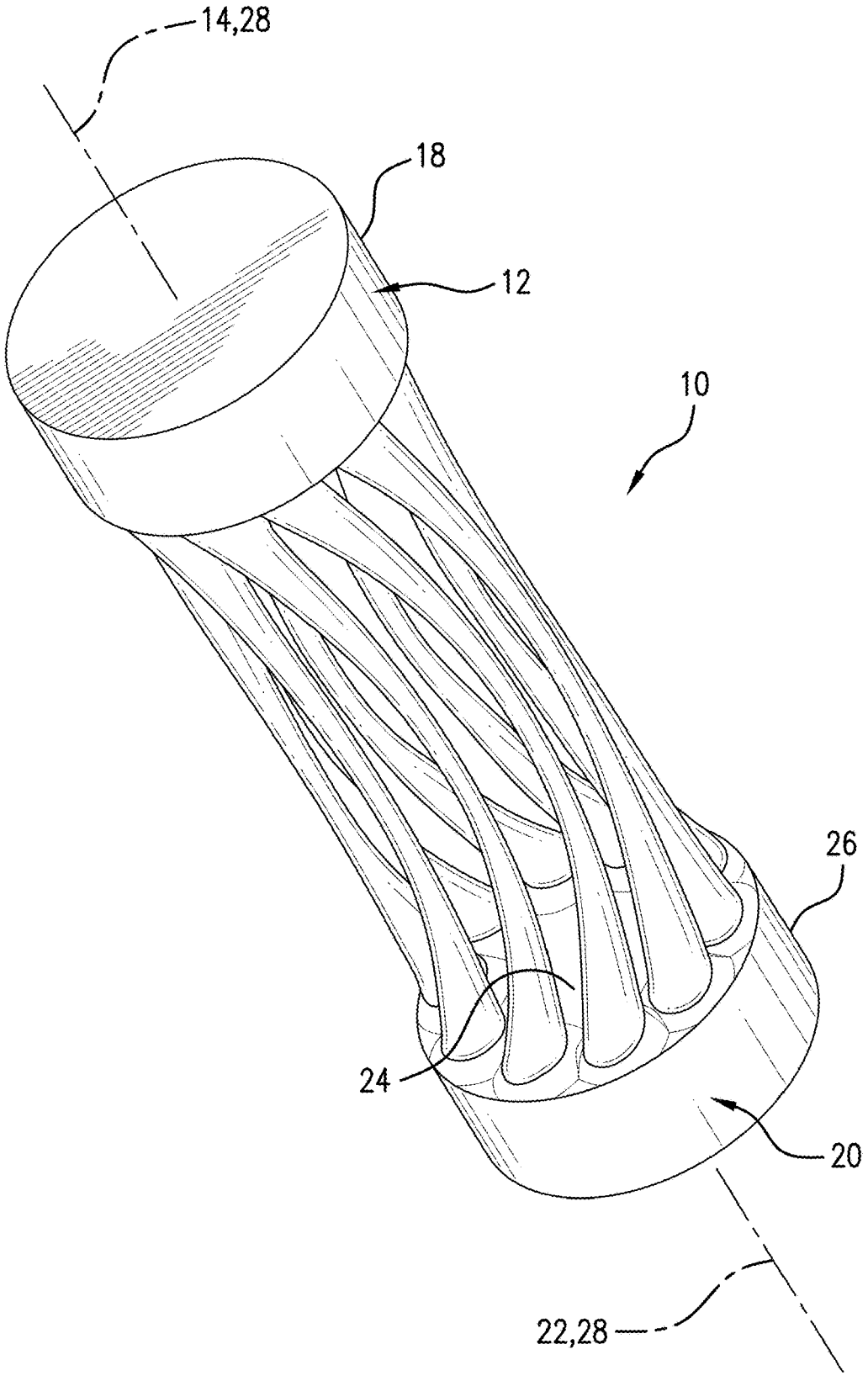
FIG. 2 is a perspective view of the tensile bar illustrated in FIG. 1.

Referring to FIGS. 1 and 2, a tensile bar 10 is illustrated. Bar 10 comprises a first support structure 12 having a longitudinal axis 14 and presenting a first engagement face 16 that crosses the longitudinal axis 14 of the first support surface 12. Face 16 may in some embodiments be orthogonally disposed relative to the axis 14 while in other embodiments, face 16 might be configured at other angles relative to the axis 14, or may be nonplanar and orthogonal or nonplanar and nonorthogonal to axis 14, for example. The first engagement face 16 includes a peripheral surface 18 that is spaced from the longitudinal axis 14 of the first support structure 12. By "spaced", in the immediately prior use, it is simply meant that the peripheral surface 18 does not intersect the axis 14. The peripheral surface 18 may be circular, or other curved shape, or may be configured with other geometry such as triangular, square, pentagonal hexagonal, septagaonal, octagonal, nonagonal, pentagonal, and so on. It will be understood by those of skill in the art that the tensile bar 10 is threaded (whether both male, both female or one male and one female in various embodiments) on both ends in order to be threadedly installed into a string system that will be used to manage tools in a borehole.

A second support structure 20 is configured with similar features having a longitudinal axis 22 that may or may not be aligned with the axis 14. Structure 20 includes a second engagement face 24 that crosses the longitudinal axis 22 of the second support structure 20, the face 24 having any of the properties noted above with respect to face 16. Also similar to face 16, second engagement face 24 includes a peripheral surface 26 that is spaced from the longitudinal axis 22 of the second support structure 20. Again here, "spaced", in the immediately prior use, it is simply meant that the peripheral surface 26 does not intersect the axis 22.

Figure 3:
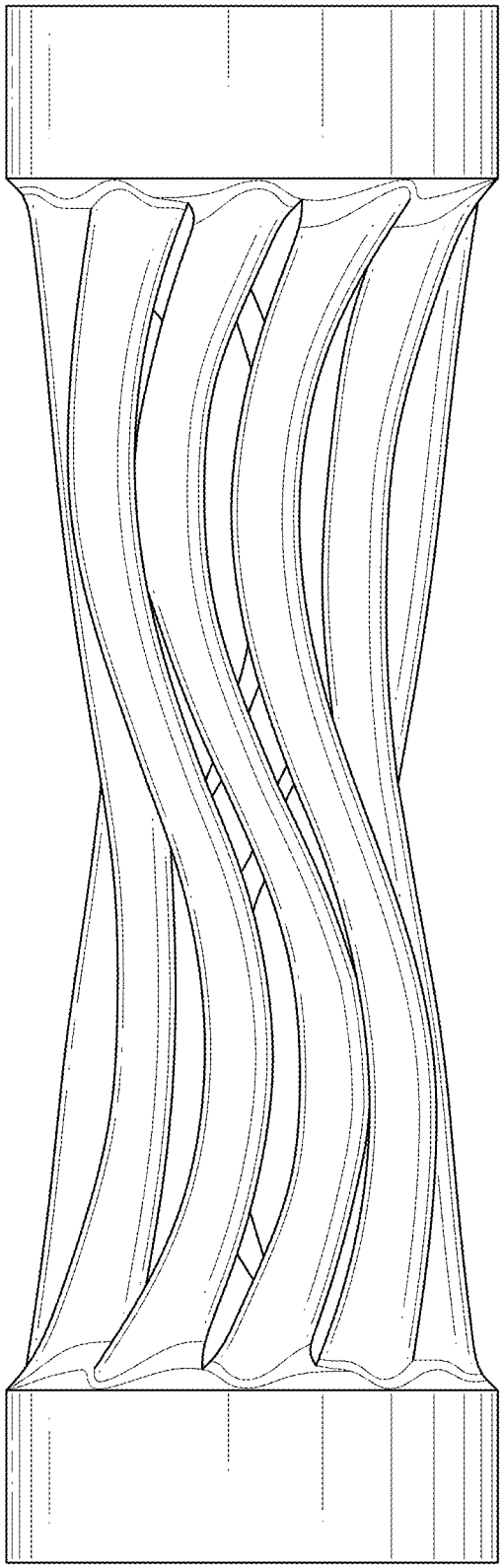
FIG. 3 is an alternate embodiment of a tensile bar as disclosed herein.
Figure 4:
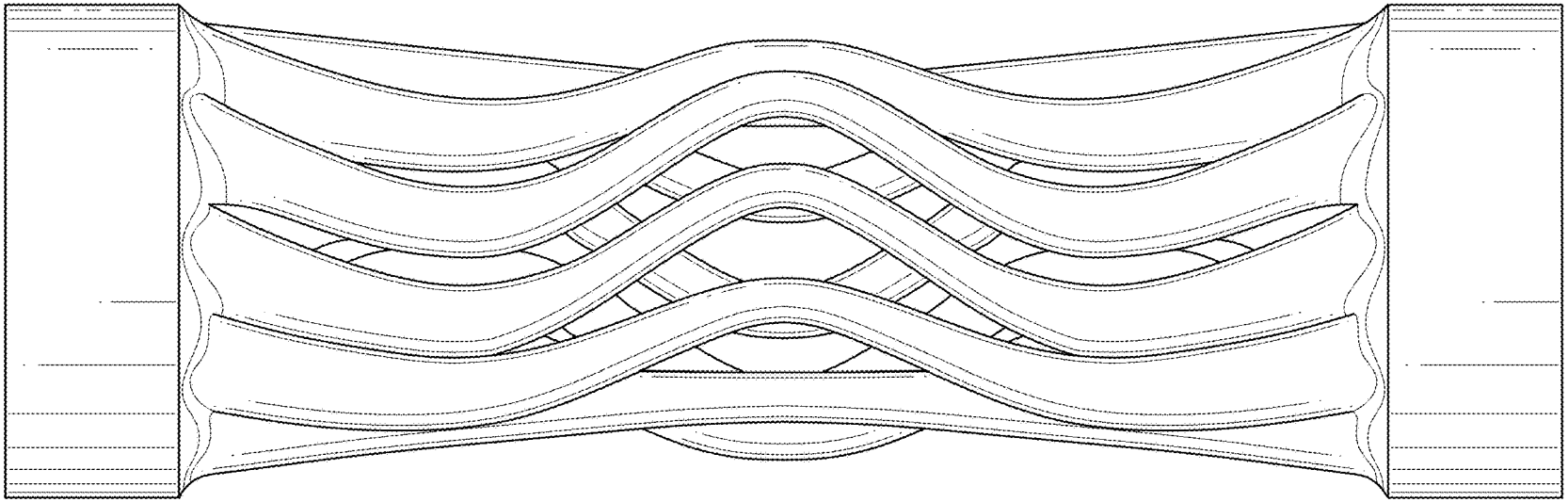
FIG. 4 is yet another embodiment of a tensile bar as disclosed herein.

In the completed tensile bar 10, which may be achieved through additive manufacturing, in an embodiment, tensile bar 10 includes a longitudinal axis 28 that may or may not be in line or parallel with the axis 14 or axis 22 (illustrated as coextensive in the Figures), the second support structure 20 is spaced from the first support structure 12 by a plurality of tensile members 30. Members 30 extend between the first engagement face 16 and the second engagement face 24. Each of the plurality of members 30 extends at least in part in a direction other than longitudinally axially of the tensile bar 10. That is to say that a member 30 may not extend directly from structure 12 to structure 20 in a line that is parallel to the axis 28 of the tensile bar 10. Each member 30 will take a tortuous route (not a straight line) between its attachment point 32 to engagement face 16 to its attachment point 34 to engagement face 24. An intersection between members 30 and points 32 and or 34 may be radiused as illustrated to avoid stress risers at that location. Acceptable radii for these locations a range from about 15% to about 30% of the diameter of the associated member (or diameter equivalent in case of a non-circular cross-section) connected to the support structure. However, with regard to the attachment points 32 and 34, a line (illustrated in dashes and labeled 36) extending therebetween must be parallel to the axis 28 of the tensile bar 10. To elaborate, the members 30 may zig and zag between point 32 and 34 but the points must be as stated. In addition, members 30 may wrap around the tensile bar 10 but only if they also unwrap themselves prior to the opposing attachment point. One member 30 may begin at point 32 and extend in a direction to wrap around the bar 10. The wrap may continue so long as a portion of the member 30 will turn the wrap direction back around and unwrap the member 30 so that point 34 will be in line with point 32, and parallel to the axis 28. It is also to be appreciated that member 30 must not extend 360 degrees or more around the bar 10 and then attach at point 34, even is point 32 and point 34 are still in lone and in parallel as described. There must be an unwrap. If there were no unwrap, even if the points 32 and 34 are in line, the bar 10 will not be functional or acceptable. The member 30 must wind and unwind between the attachment points 32 and 34. Various additional embodiments illustrate the point in FIGS. 3 and 4.

Figure 5A:
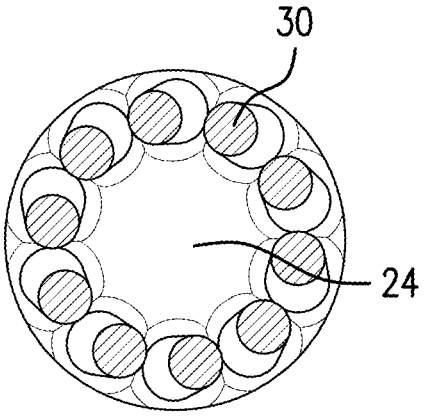
FIGS. 5A-5D are a series of cross section views taken from FIG. 1 in the locations indicated by identifiers 5A-5D.
Figure 5B:
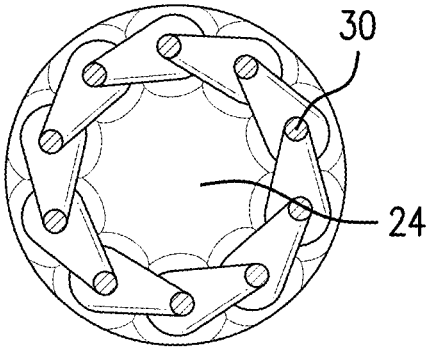
Figure 5C:
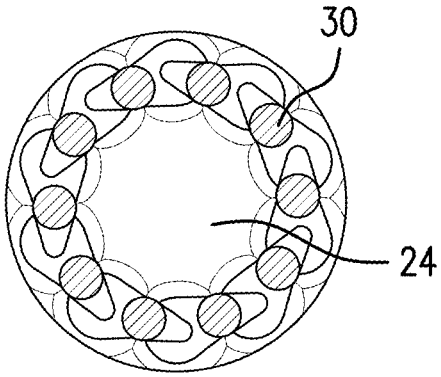
Figure 5D:
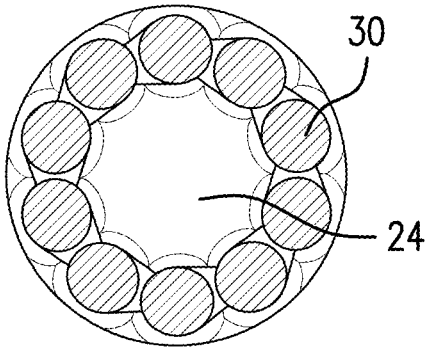

In embodiments, referring to FIGS. 5A-5D, the members 30 may have consistent geometry over their lengths or may have changing geometry over their lengths, for example a thinner diameter or cross section at a center span than at the attachment points 32/34 (compare FIGS. 5A and 5D with FIG. 5B, for example). This would promote engineered failure at a particular point over the length of the bar 10, for example, at the center thereof. Further, the members 30 may be engineered with different density or porosity over their lengths or a geometric discontinuity to provide for a stress riser or a strengthened zone for the same purpose of designating where failure is to occur and at what load. In other embodiments or in combination with other examples herein, the members 30 may comprise different materials or different material properties over their lengths again for the same purpose of controlling failure point and load. In some embodiments, individual ones of the members 30 may be configured to break at different loads to provide for indications at surface while preserving the ability to pull out of hole with the tool.

Figure 6:
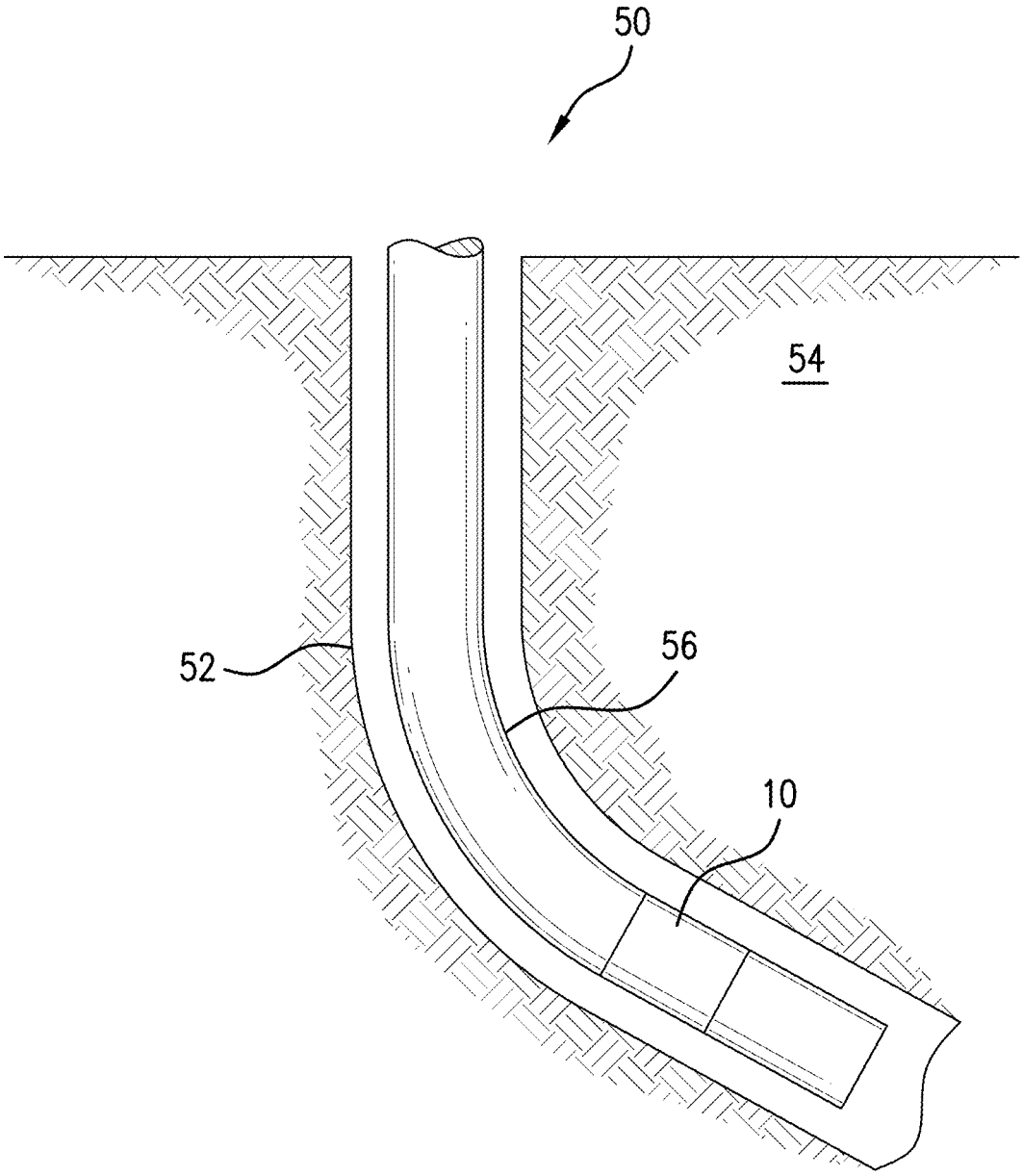
FIG. 6 is a view of a borehole system including a tensile bar as disclosed herein.

Referring to FIG. 6, a borehole system 50 is illustrated. The system 50 comprises a borehole 52 in a subsurface formation 54. A string 56 is disposed within the borehole 52. A tensile bar 10 as disclosed herein is disposed within or as a part of the string 56.

Set forth below are some embodiments of the foregoing disclosure:

Embodiment 1: A tensile bar, including a first support structure having a longitudinal axis and presenting a first engagement face that crosses the longitudinal axis of the first support structure, the first engagement face having a peripheral surface that is spaced from the longitudinal axis of the first support structure, a second support structure having a longitudinal axis and presenting a second engagement face that crosses the longitudinal axis of the second support structure, the second engagement face having a peripheral surface that is spaced from the longitudinal axis of the second support structure, the second support structure spaced from the first support structure; and a plurality of tensile members extending between the first engagement face and the second engagement face, each member of the plurality of members extending at least in part in a direction other than longitudinally axially of the tensile bar, each member of the plurality of members extending from a first point on the first engagement face to a second point on the second engagement face, a line between the first point and the second point being parallel to a longitudinal axis of the tensile bar.

Embodiment 2: The bar as claimed as in any prior embodiment, wherein a member of the plurality of members comprises a consistent cross-sectional geometry over their lengths.

Embodiment 3: The bar as in any prior embodiment, wherein the cross-sectional geometry is circular.

Embodiment 4: The bar as in any prior embodiment, wherein a member of the plurality of members comprises an inconsistent cross-sectional geometry over their lengths.

Embodiment 5: The bar as in any prior embodiment, wherein a member of the plurality of members comprises varying properties over their lengths.

Embodiment 6: The bar as in any prior embodiment, wherein the properties include density, porosity, geometric deformity, change in material, change in material properties, and combinations including at least one of the foregoing.

Embodiment 7: The bar as in any prior embodiment, wherein the geometric deformity is a stress riser.

Embodiment 8: The bar as in any prior embodiment, wherein a member of the plurality of members extends at least in part in a second direction other than axially of the tensile bar.

Embodiment 9: The bar as in any prior embodiment, wherein a member of the plurality of members zig zags from the first point to the second point.

Embodiment 10: The bar as in any prior embodiment, wherein the first engagement face orthogonally crosses the longitudinal axis of the first support structure.

Embodiment 11: The bar as in any prior embodiment, wherein the second engagement face orthogonally crosses the longitudinal axis of the second support structure.

Embodiment 12: The bar as in any prior embodiment, wherein the longitudinal axis of the first support structure is parallel to the longitudinal axis of the second support structure.

Embodiment 13: The bar as in any prior embodiment, wherein the longitudinal axis of the first support structure is coextensive with the longitudinal axis of the second support structure.

Embodiment 14: The bar as in any prior embodiment, wherein the longitudinal axis of the first support structure is parallel to the longitudinal axis of the second support structure.

Embodiment 15: The bar as in any prior embodiment, wherein the longitudinal axis of the first support structure and the longitudinal axis of the second support structure are coextensive with the longitudinal axis of the tensile bar.

Embodiment 16: The bar as in any prior embodiment, wherein one or both of the first engagement face peripheral surface and the second engagement face peripheral surface is circular.

Embodiment 17: A method for making the tensile bar as in any prior embodiment, including applying a material from an additive manufacturing machine to a build plate in the form of a layer of the tensile bar, applying the material to the layer, and repeating applying the material until the tensile bar has grown to a full shape of the tensile bar.

Embodiment 18: An equipment removal tool, including a string, and a tensile bar as in any prior embodiment disposed within or as a part of the string.

Embodiment 19: A borehole system, including a borehole in a subsurface formation, a string in the borehole, and a tensile bar as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A tensile bar, comprising:

a first support structure configured for attachment to a downhole string for a wellbore, the first support structure having a longitudinal axis and presenting a first engagement face that crosses the longitudinal axis of the first support structure, the first engagement face having a peripheral surface that is spaced from the longitudinal axis of the first support structure;

a second support structure having a longitudinal axis and presenting a second engagement face that crosses the longitudinal axis of the second support structure, the second engagement face having a peripheral surface that is spaced from the longitudinal axis of the second support structure, the second support structure spaced from the first support structure; and a plurality of tensile members extending between the first engagement face and the second engagement face, each member of the plurality of members extending at least in part in a direction other than longitudinally axially of the tensile bar, each member of the plurality of tensile members extending from a first point on the first engagement face to a second point on the second engagement face, a line between the first point and the second point for each member being parallel to a longitudinal axis of the tensile bar, wherein the plurality of tensile members are configured to fail during use in the wellbore in order to protect the downhole string.

2. The bar as claimed in claim 1, wherein a member of the plurality of members comprises a consistent cross-sectional geometry over their lengths.

3. The bar as claimed in claim 2, wherein the cross-sectional geometry is circular.

4. The bar as claimed in claim 1, wherein a member of the plurality of members comprises an inconsistent cross-sectional geometry over their lengths.

5. The bar as claimed in claim 1, wherein a member of the plurality of members comprises varying properties over their lengths.

6. The bar as claimed in claim 5, wherein the properties include density, porosity, geometric deformity, change in material, change in material properties, and combinations including at least one of the foregoing.

7. The bar as claimed in claim 6, wherein the geometric deformity is a stress riser.

8. The bar as claimed in claim 1, wherein a member of the plurality of members extends at least in part in a second direction other than axially of the tensile bar.

9. The bar as claimed in claim 8, wherein a member of the plurality of members zig zags from the first point to the second point.

10. The bar as claimed in claim 1, wherein the first engagement face orthogonally crosses the longitudinal axis of the first support structure.

11. The bar as claimed in claim 1, wherein the second engagement face orthogonally crosses the longitudinal axis of the second support structure.

12. The bar as claimed in claim 1, wherein the longitudinal axis of the first support structure is parallel to the longitudinal axis of the second support structure.

13. The bar as claimed in claim 1, wherein the longitudinal axis of the first support structure is coextensive with the longitudinal axis of the second support structure.

14. The bar as claimed in claim 1, wherein the longitudinal axis of the first support structure is parallel to the longitudinal axis of the second support structure.

15. The bar as claimed in claim 1, wherein the longitudinal axis of the first support structure and the longitudinal axis of the second support structure are coextensive with the longitudinal axis of the tensile bar.

16. The bar as claimed in claim 1, wherein one or both of the first engagement face peripheral surface and the second engagement face peripheral surface is circular.

17. A method for making the tensile bar as claimed in claim 1, comprising:

applying a material from an additive manufacturing machine to a build plate in the form of a layer of the tensile bar;

applying the material to the layer; and repeating applying the material until the tensile bar has grown to a full shape of the tensile bar.

18. An equipment removal tool, comprising:

a string; and a tensile bar as claimed in claim 1 disposed within or as a part of the string.

19. A borehole system, comprising:

a borehole in a subsurface formation;

a string in the borehole; and a tensile bar as claimed in claim 1 disposed within or as a part of the string.

20. A tensile bar, comprising:

a first support structure having a longitudinal axis and presenting a first engagement face that crosses the longitudinal axis of the first support structure, the first engagement face having a peripheral surface that is spaced from the longitudinal axis of the first support structure;

a second support structure having a longitudinal axis and presenting a second engagement face that crosses the longitudinal axis of the second support structure, the second engagement face having a peripheral surface that is spaced from the longitudinal axis of the second support structure, the second support structure spaced from the first support structure; and a plurality of tensile members extending between the first engagement face and the second engagement face, each member of the plurality of members extending from a first point on the first engagement face to a second point on the second engagement face, a line between the first point and the second point for each member being parallel to a longitudinal axis of the tensile bar and each member extending at least in part in a direction other than longitudinally axially of the tensile bar such that each member takes a route other than directly along the line from the first point to the second point.

* * * * *